US010341779B2

(12) United States Patent
Li et al.

(10) Patent No.: US 10,341,779 B2
(45) Date of Patent: Jul. 2, 2019

(54) MINIATURE SOUNDING DEVICE

(71) Applicants: Shuai Li, Shenzhen (CN); Fan Zhang, Shenzhen (CN)

(72) Inventors: Shuai Li, Shenzhen (CN); Fan Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 62 days.

(21) Appl. No.: 15/416,819

(22) Filed: Jan. 26, 2017

(65) Prior Publication Data

US 2018/0027335 A1 Jan. 25, 2018

(30) Foreign Application Priority Data

Jul. 20, 2016 (CN) ..... 2016 2 0770107 U

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |
| ***H04R 1/06*** | (2006.01) |
| ***H04R 7/04*** | (2006.01) |
| *H04R 9/04* | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 1/06* (2013.01); *H04R 7/04* (2013.01); *H04R 9/045* (2013.01); *H04R 2499/11* (2013.01)

(58) Field of Classification Search

CPC ..... H04R 9/022
USPC ..... 381/176, 185, 398, 399, 401, 423
See application file for complete search history.

(56) References Cited

U.S. PATENT DOCUMENTS

2011/0274309 A1* 11/2011 Doh ..... H04R 9/047 381/398
2014/0056465 A1* 2/2014 Li ..... H04R 9/025 381/400
2014/0376766 A1* 12/2014 Chen ..... H04R 9/02 381/400

* cited by examiner

*Primary Examiner* — Yosef K Laekemariam
(74) *Attorney, Agent, or Firm* — Na Xu; IPro, PLLC

(57) ABSTRACT

The present disclosure provides a miniature sounding device, the miniature sounding device includes a fixing system; and a vibrating system including a diaphragm, a voice coil which is arranged underneath the diaphragm and is configured to drive the diaphragm to vibrate and sound, and a flexible circuit board arranged at an external side of the voice coil, the voice coil including a first end surface which is connected with the diaphragm and a second end surface which is opposite to the first end surface, the flexible circuit board is level with the first end surface. In the miniature sounding device provided by the present disclosure, the arrangement that the flexible circuit board is level with the voice coil can save height space.

10 Claims, 5 Drawing Sheets

MINIATURE SOUNDING DEVICE

TECHNICAL FIELD

The present disclosure relates to the field of acoustoelectric transducing technologies and, particularly, relates to a miniature sounding device.

BACKGROUND

In order to be adapted to the development of various stereo equipment and information communication equipment on miniaturization and multifunction, the miniature sounding device used in such equipment are required to be further miniaturized, so as to achieve a more compact structure of the miniature sounding device and other surrounding elements. Particularly, as the mobile phones are becoming lighter and thinner, the miniature sounding device used therein are required to be furthermore miniaturized.

In relevant art, the dome, voice diaphragm, flexible circuit board and voice coil in the vibrating system of the miniature sounding device are stacked in a manner from top to bottom, which not only restricts the inner diameter of the voice coil and thus influences acoustic performance of the miniature sounding device, but also increases the size of the miniature sounding device in the height direction and thus increase the overall size, thereby influencing the occupied space in the equipment and preventing the electronic equipment from being miniaturized, lighter and thinner.

Thus, it is necessary to provide an improved miniature sounding device to solve the abovementioned technical problems.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
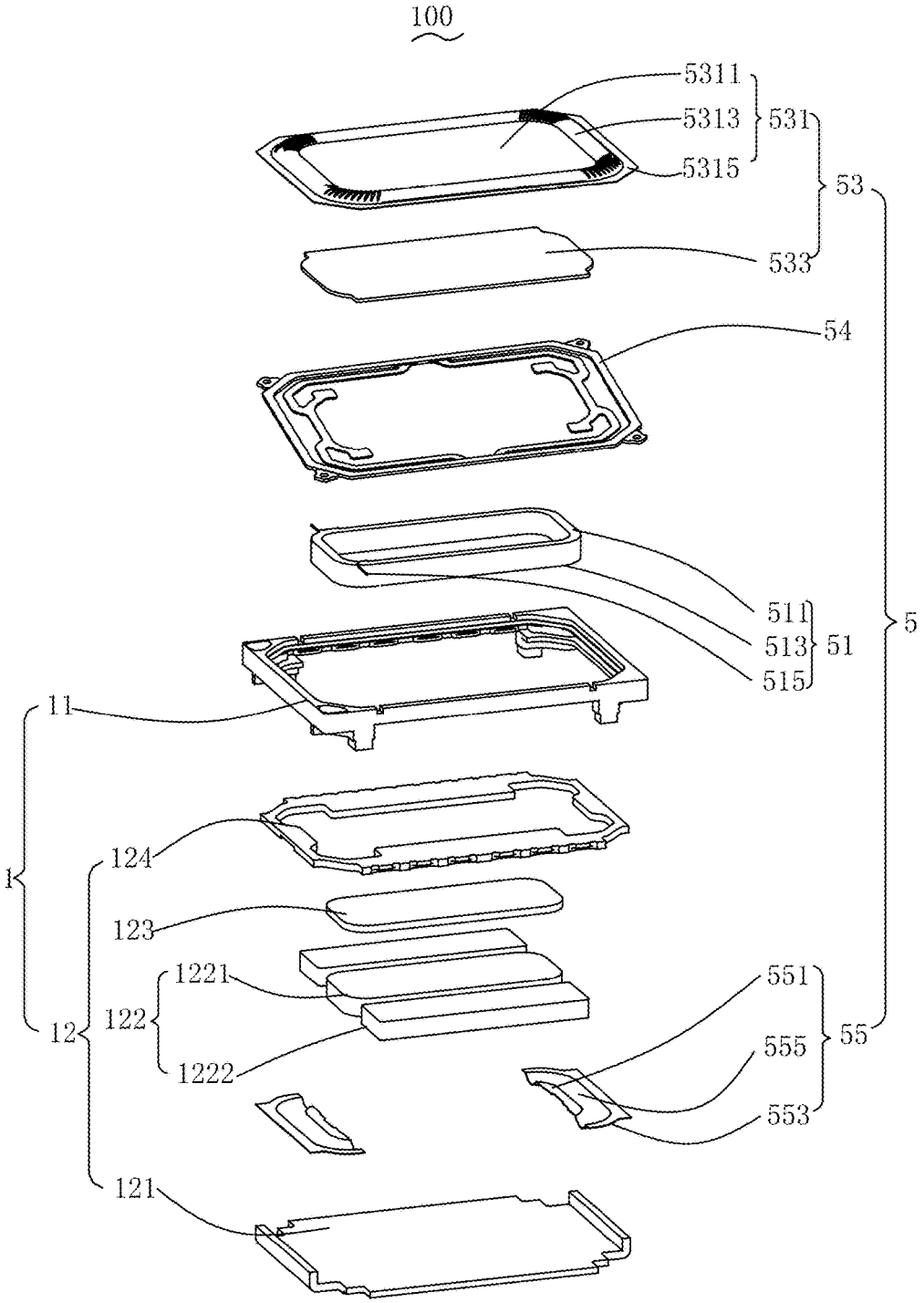
FIG. 1 is a schematic exploded view of a three-dimensional structure of a miniature sounding device according to the present disclosure.

Please refer to FIG. 1, which is a schematic exploded view of a three-dimensional structure of a miniature sounding device of the present disclosure. The miniature sounding device 100 includes a fixing system 1 and a vibrating system 5, the fixing system 1 includes a frame 11 having an accommodating space and a magnetic circuit system 12 which is accommodated in the frame 11, the vibrating system 5 is driven to vibrate and sound by the magnetic circuit system 12.

The magnetic circuit system 12 includes a yoke 121 which is accommodated in the frame 11, a magnet 122 which is adhered onto the yoke 121, a pole plate 123 and an upper clamping plate 124.

The magnet 122 includes a main magnet 1221 and two auxiliary magnets 1222 which are symmetrically arranged at two sides of the main magnet 1221. A magnetic gap is formed between the main magnet 1221 and the two auxiliary magnets 1222.

The upper clamping plate 124 is stacked at the auxiliary magnet 1222 and is fixedly supported by the frame 11. The upper clamping plate 124 is of a flat plate shape with a through hole.

The pole plate 123 is stacked on the main magnet 1221, and is located in the through hole of the upper clamping plate 124 and is in a same horizontal plane with the upper clamping plate 124.

Figure 2:
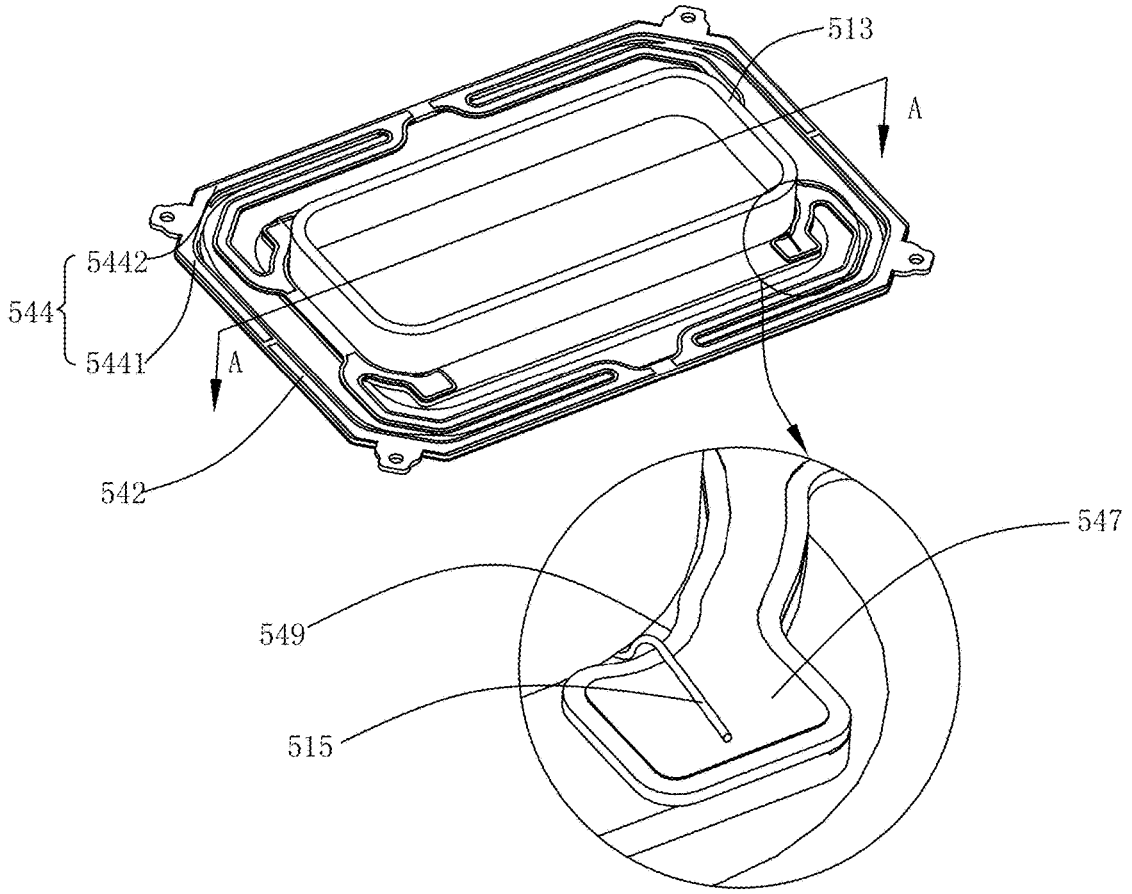
FIG. 2 is a schematic partial structural diagram of an assembled vibrating system in the miniature sounding device shown in FIG. 1.
Figure 3:
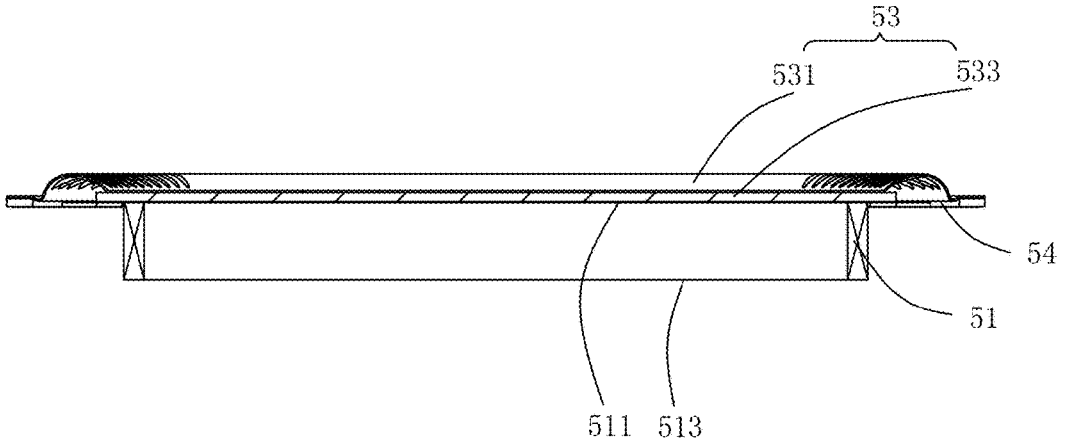
FIG. 3 is a schematic structural diagram of a cross section along line A-A shown in FIG. 2.

Referring to FIG. 2 and FIG. 3, FIG. 2 is a schematic partial structural diagram of an assembled vibrating system in the miniature sounding device shown in FIG. 1; FIG. 3 is a schematic structural diagram of a cross section along line A-A shown in FIG. 2.

The vibrating system 5 includes a voice coil 51, a diaphragm 53, a flexible circuit board 54 and a supporting piece 55.

An end of the voice coil 51 is inserted into the magnetic gap formed between the main magnet 1221 and the auxiliary magnets 1222, the vice coil 51 includes a first end surface 511 and a second end surface 513 which is opposite to the first end surface 511, the first end surface 511 is adhesively fixed at the diaphragm 53, the voice coil 51 further includes a voice coil lead wire 515 which extends out from the first end surface 511.

The diaphragm 53 includes a voice diaphragm 531 and a dome 533 at a side of the voice diaphragm 531 adjacent to the frame 11, the voice diaphragm 531 can be adhesively fixed with the dome 533.

The voice diaphragm 531 includes a main body portion 5311, a suspension portion 5313 and an extending portion 5315, the suspension portion 5313 extends outward from the main body portion 5311 and surrounds the main body portion 5311, and the extending portion 5315 extends outward from the suspension portion 5313 and surrounds the suspension portion 5313. Both the main body portion 5311 and the extending portion 5315 are of a plane structure, and the suspension portion 5313 is of a cambered surface structure.

A side of the main body portion 5311 of the voice diaphragm 531 adjacent to the frame 11 is fixedly connected with the dome 533. The dome 533 can extends outward beyond the main body portion 5311 to the suspension portion 5313 of the voice diaphragm 531, which can guarantee the width of the suspension portion 5313 and in the meantime maximize the inner diameter of the voice coil 51, so as to improve the acoustic performance of the miniature sounding device 100.

The voice coil 51 is adhesively fixed with the dome 533.

The flexible circuit board 54 is arranged at an external side of the voice coil 51, and has a first surface 541 which is adjacent to the diaphragm 53 and a second surface 542 which is arranged opposite to the first surface 541; the flexible circuit board 54 includes a first fixing portion 544 which is fixedly connected with the voice diaphragm 531, a second fixing portion 545 which is fixedly connected with the dome 533, a flexible connecting arm 546 which connects the first fixing portion 544 with the second fixing portion 545, a first bonding pad 547 which extends out from the second fixing portion 545 and is welded with the voice coil lead wire 515, and a second bonding pad 548 that extends out from the first fixing portion 544 and is electrically connected with an external circuit.

The first fixing portion 544 is of a ring shape, which includes a pair of short axis walls 5441 opposite to a short axis edge of the voice coil 51 and a pair of long axis walls 5442 opposite to a long axis edge of the voice coil 51. The first surface 541 of the first fixing portion 544 is adhesively fixed with the extending portion 5315 of the voice diaphragm 531, the second surface 542 of the first fixing portion 544 is adhesively fixed with the frame 11.

Figure 4:
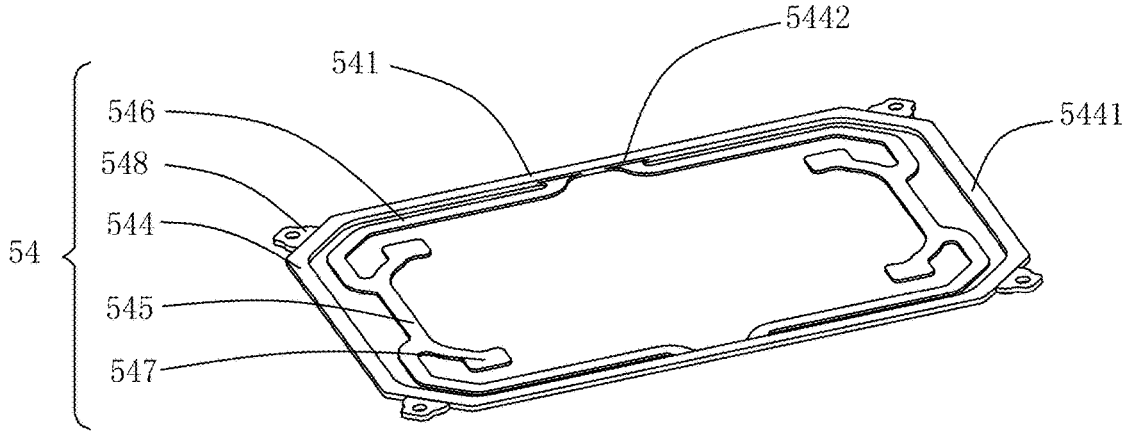
FIG. 4 is a perspective view of a flexible circuit board in the miniature sounding device according to a first exemplary embodiment shown in FIG. 1.
Figure 5:
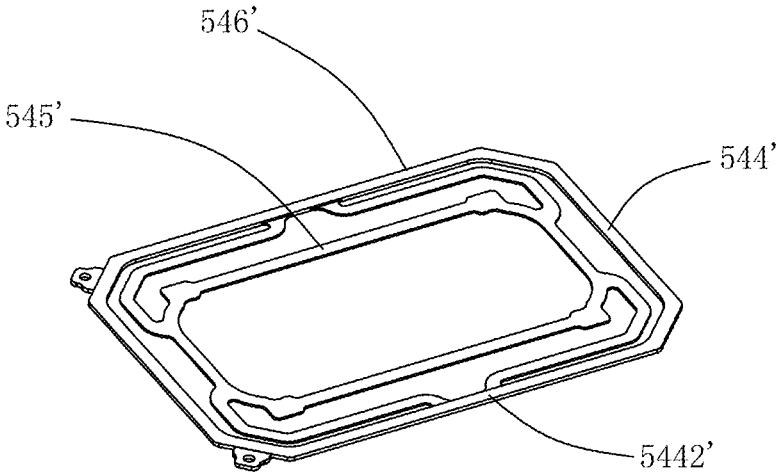
FIG. 5 is a perspective view of a flexible circuit board in the miniature sounding device according to a second exemplary embodiment shown in FIG. 1.

The second fixing portion 545 is surrounded by the first fixing portion 544, the first surface 541 of the second fixing portion 545 is adhesively fixed with a side of the dome 533 far away from the voice diaphragm 531, as shown in FIG. 4, in a first exemplary embodiment, there is a pair of second fixing portions 545, and the pair of second fixing portions 545 are of the same structure, two short axis edges of the voice coil 51 are respectively provided with one second fixing portion 545; one end of the flexible connecting arm 546 is connected with the second fixing portion 545, the other end is connected with the middle portion of the long axis wall 5442 of the first fixing portion 544, there are four flexible connecting arms 546, each second fixing portion 545 is connected with the first fixing portion 544 by two flexible connecting arms 546, i.e., two sides of the second fixing portion 545 are respectively provided with a flexible connecting arm 546, and the flexible connecting arms 546 are of the same structure and are symmetrically arranged. Of course, the second fixing portion 545 may be of a ring structure, as shown in FIG. 5, in a second exemplary embodiment, the second fixing portion 545' is of a ring structure which surrounds an external side of the voice coil 51, the ring shaped second fixing portion 545' are connected with the middle of the long axis wall 5442' of the first fixing portion 544' by the four flexible connecting arms 546'.

As shown in FIG. 3, the first surface 541 of the flexible circuit board 54 is level with the first end surface 511 of the voice coil 51, so that the flexible circuit board 54 does not occupy height space, so as to save the height space of the miniature sounding device 100.

The first bonding pad 547 extends out from the second fixing portion 545 and is welded with the voice coil lead wire 515, the voice coil lead wire 515 is fixedly welded with the second surface 542 of the flexible circuit board 54, a side of the first bonding pad 547 of the flexible circuit board 54 adjacent to the voice coil 51 is provided with a gap 549 configured to provide space for the voice coil lead wire 515, the voice coil lead wire 515 is led out from the second end surface 513 of the voice coil 51, passes through the gap 549 and is welded with the first surface 541 of the first bonding pad 547, so as to avoid large-angle bending of the voice coil lead wire 515, thereby reducing risks of disconnection of the voice coil lead wire 515.

The second bonding pad 548 is arranged at the corner of the first fixing portion 544, a through hole is provided on the second bonding pad 548, and the through hole enables the welding material to enter into the through hole during welding, so as to increase stability of the welding.

The supporting piece 55 is a diaphragm made of thin film material, including a third fixing portion 551 which is connected with the second end surface 513 of the voice coil 51, a fourth fixing portion 553 which is connected with the fixing system 1, and a concave portion 555 which connects the third fixing portion 551 with the fourth fixing portion 553. In the present embodiment, the fourth fixing portion 553 is fixed with the frame 11. There are a pair of supporting pieces 55 of the same structure, and the short axis edges of the voice coil 51 are respectively provided with one supporting piece 55.

The supporting piece 55 is configured to fix and support the voice coil 51.

In the miniature sounding device 100 provided by the present disclosure, the flexible circuit board 54 is level with the first end surface 511 of the voice coil 51, which effectively reduces the size of the miniature sounding device 100 in the height direction, so as to reduce the overall size of the miniature sounding device 100; moreover, the dome 533 is adhesively fixed with a side of voice diaphragm 531 adjacent to the fixing system 1, and the voice coil 51 is adhesively fixed with the dome 533, which can guarantee the width of the suspension portion 5313 of the voice diaphragm 531 and in the meantime maximize the inner diameter of the voice coil 51, so as to improve the acoustic performance of the miniature sounding device 100.

The above-mentioned are merely the preferred embodiments of the present disclosure, it should be noted that, the person skilled in the art may make improvements without departing from the creative concept of the present disclosure, however, these improvements shall all fall into the protection scope of the present disclosure.

What is claimed is:

1. A miniature sounding device, comprising:

a fixing system; and a vibrating system comprising a diaphragm, a voice coil which is arranged underneath the diaphragm and is configured to drive the diaphragm to vibrate and sound, and a flexible circuit board arranged at an external side of the voice coil, the voice coil comprising a first end surface which is connected with the diaphragm and a second end surface which is opposite to the first end surface, the flexible circuit board and the voice coil connected to a horizontal plane of the diaphragm;

wherein, a first surface adjacent to the diaphragm of the flexible circuit board is level with the first end surface of the voice coil.

2. The miniature sounding device as described in claim 1, wherein, the diaphragm comprises a voice diaphragm, and a dome arranged at a side of the voice diaphragm adjacent to the fixing system.

3. The miniature sounding device as described in claim 2, wherein, the flexible circuit board comprises a first fixing portion which is fixedly connected with the voice diaphragm, a second fixing portion which is fixedly connected with the dome, and a flexible connecting arm which connects the first fixing portion with the second fixing portion.

4. The miniature sounding device as described in claim 3, wherein, the second fixing portion of the flexible circuit board is arranged at a short axis edge side of the voice coil.

5. The miniature sounding device as described in claim 4, wherein, the first fixing portion of the flexible circuit board is of a ring shape, the first fixing portion comprises a pair of short axis walls opposite to a short axis edge of the voice coil and a pair of long axis walls opposite to a long axis edge of the voice coil.

6. The miniature sounding device as described in claim 5, wherein, one end of the flexible connecting arm is connected with the second fixing portion, the other end of the flexible connecting arm is connected with the long axis wall of the first fixing portion.

7. The miniature sounding device as described in claim 3, wherein, the second fixing portion of the flexible circuit board is adhesively connected with the dome.

8. The miniature sounding device as described in claim 3, wherein, the voice diaphragm comprises a main body portion which is fixedly connected with the dome, a suspension portion which extends outward from the main body portion and surrounds the main body portion, and an extending portion which extends outward from the suspension portion and surrounds the suspension portion; the extending portion is fixedly connected with the first fixing portion.

9. The miniature sounding device as described in claim 8, wherein, the dome extends outward beyond the main body portion of the voice diaphragm.

10. The miniature sounding device as described in claim 1, wherein, the vibrating system further comprises a supporting piece arranged underneath the voice coil and configured to support the voice coil, the supporting piece comprises a third fixing portion which is connected with the second end surface of the voice coil, a fourth fixing portion which is connected with the fixing system, and a concave portion which connects the third fixing portion with the fourth fixing portion.

* * * * *